United States Patent [19]

Williams

[11] Patent Number: 4,979,724

[45] Date of Patent: Dec. 25, 1990

[54] DOUBLE ACTION EXPANSION WEDGE FOR MOUNTING COLLAR

[75] Inventor: Jeffery D. Williams, Tumacacori, Ariz.

[73] Assignee: Wedge-Loc Co., Inc., Rio Rico, Ariz.

[21] Appl. No.: 413,285

[22] Filed: Sep. 27, 1989

[51] Int. Cl.[5] ..... E04H 12/22

[52] U.S. Cl. ..... 256/36; 256/56; 256/70; 403/409.1; 403/374

[58] Field of Search ..... 256/70, 36, 56; 403/409.1, 374; 248/231.3

[56] References Cited

U.S. PATENT DOCUMENTS

| | | | |
|---|---|---|---|
| 261,727 | 7/1882 | Kimball . | |
| 1,330,808 | 2/1920 | James . | |
| 2,955,793 | 10/1960 | Finley | 248/231.3 X R |
| 3,670,468 | 6/1972 | Cordell, Sr. | 52/298 |
| 3,675,598 | 7/1972 | Kesilman et al. | 403/374 X |
| 3,820,758 | 6/1974 | Berg, Jr. et al. | 256/10 |
| 3,874,640 | 4/1975 | Wagner et al. | 256/47 |
| 4,077,611 | 3/1978 | Wilson | 256/10 |
| 4,286,897 | 9/1981 | Suskind | 248/231.3 X |
| 4,763,879 | 8/1988 | Wasicek | 256/36 |

*Primary Examiner*—Andrew V. Kundrat

*Attorney, Agent, or Firm*—LaValle D. Ptak

[57] ABSTRACT

A double action expansion wedge is disclosed for attaching a collar to a T-post fence for utilization in conjunction with a bracing system for fences made from such T-posts. A hollow collar member has internal dimensions selected to slide over the posts, so that the collar can be positioned vertically between the lugs of the post at a desired location. The double action expansion cam wedge secures the collar between adjacent lugs on the post by tightly wedging the collar and post together. The double action expansion causes the top edge of the collar and the bottom edge of the collar both to be wedged against the post to hold the collar in alignment with the post.

14 Claims, 3 Drawing Sheets

DOUBLE ACTION EXPANSION WEDGE FOR MOUNTING COLLAR

RELATED APPLICATION

This application is related to the co-pending application to Kenneth A. Wagner, Ser. No. 07/256,451, filed Oct. 12, 1988, now U.S. Pat. No. 4,889,322 and assigned to the same assignee as the present application.

BACKGROUND

Fence posts are widely used in the construction of fences for a variety of purposes such as animal management, property boundaries, snow barriers and the like. A popular type of fence post is made of steel and has a T-shaped cross-section, commonly called "T-posts". The flat vertical face has a spaced series of lugs or projections extending in a line opposite the rear or "leg" portion of the T cross-section. These lugs then are used to facilitate the attachment of wire (usually barbed wire), which is stretched along the posts and secured at intervals to braced line posts and corner posts. Bracing for the line posts and corner posts must be solid if the fence wire is to maintain its tension over a period of time.

The shape of metal T-posts does not facilitate simple attachment of braces with common hardware. Usually, the posts in a fence system which require braces are made from angle iron. Bracing of such posts is slow and cumbersome, since normally an angle iron brace is secured to the angle iron post with makeshift hardware. Frequently, a hole must be drilled through the post to secure the brace. Since fences of this type frequently are located substantial distances from household power sources, portable generators or battery operated tools are necessary. Conventional bracing also typically secures the opposite or lower end of the brace in the soil, either with driven stakes or poured concrete. It is readily apparent that the bracing of T-posts in this manner is inefficient and costly.

Devices have been developed for attachment to a T-post which clip onto the posts through a type of spring action or which are secured to the posts by means of threaded fasteners. Two patents disclosing devices for permitting the subsequent mounting of electric fence wire on metal T-posts are the Burg U.S. Pat. No. 3,820,758 and Wilson U.S. Pat. No. 4,077,611. Both of these patents disclose a clip-on member made of insulating material which snaps over the post and is held in place by friction. Since the devices of both of these patents include a portion which rests on the post between the positioning lugs, vertical movement of the mounting device is restricted by the lugs located above and below the device.

The Wagner U.S. Pat. No. 3,874,640 discloses an attachment for placement on a T-post between adjacent lugs which facilitates the handling or tensioning of barbed wire, so that the wire may be stretched first and then raised out of the device and attached to the fence post. This is a temporary guide which is secured to the post only during the time the wire tensioning operation is effected.

The Cordell U.S. Pat. No. 3,670,468 is directed to a wedge for removably securing and aligning a T-post inside a larger pipe for use in temporary fencing. The T-post loosely fits within the pipe, and the wedge then holds it in place vertically within the pipe until removal of the wedge permits subsequent removal of the post. A substantial length of the post, including the positioning lugs on the front is enclosed within the pipe at the bottom end of the post.

In the Wasicek U.S. Pat. No. 4,763,879, a removable collar, which has a brace member welded to it, is placed over a T-post. The collar is of a cylindrical shape and has an aperature in it for receiving a projection on the T-post when the collar is placed in the desired vertical position on the post. A wedge then is utilized to removably secure the collar to the post. Because the collar is cylindrical, the wedge makes contact with the collar in only two spaced-apart locations when it is driven between the collar and the post. In addition, because a single wedge is used, there is a tendency for the collar to tip or tilt on the post.

The above-identified co-pending application is an improvement over the device shown in the Wasicek Patent. In the co-pending application Ser. No. 07/256,451, a collar having a rectangular internal configuration is placed between adjacent lugs on a T-post, and a wedge is driven between the rear of the T-post and the collar to hold it in place. Because of the rectangular internal configuration, the wedge makes a substantial contact with the internal surface of the collar to firmly and securely hold the collar in place. There still is a tendency, however, for the collar to tip or tilt slightly because of the manner in which the wedge applies pressure between the post and a region of the collar located primarily along its upper edge.

The James U.S. Pat. No. 1,330,808 discloses a different type of fence post clamp for use on a cylindrical pipe fence post. The James fence post clamp has a generally cylindrical cross-section which is open at one edge for clamping around a fence post. The clamp is held in place by pressure applied through the open edge. This open edge also includes a slot in it, and the end of a cross-brace is inserted into the slot. The cross-brace has a hole through it, as does the extension on the clamp. A bolt then is placed through the holes in the clamp and the end of the cross-brace to secure the clamp onto the fence post and to secure the cross-brace to the clamp. This device is not intended for use with a T-post type of fence.

Another type of slide-on collar for use in a bracing system for fence posts is disclosed in the Holmes British Pat. No. 598,417. This patent is directed to a bracing system for use with wooden fence posts having a rectangular cross-section. A metal collar has an internal configuration permitting it to be slideably located at different vertical locations on the fence post. Once the desired location is determined, the collar is secured in place by a wood screw or other suitable fastener extending through an aperature in the collar into the post. The collar of Holmes clearly is not suitable for use with a T-post fence system.

It is desirable to provide an improved mounting collar and attachment mechanism for field installation to facilitate the bracing of T-posts used in a fence system and for overcoming the disadvantages of the prior art.

SUMMARY OF THE INVENTION

It is an object of this invention to provide a simple and efficient hardware system for use in bracing T-post fences.

It is an additional object of this invention to provide a T-post hardware and bracing system in which the various hardware components may be quickly and effectively mounted, assembled, and disassembled with standard hand tools.

It is another object of this invention to provide a mounting collar for mounting various accessories on a standard T-post to adapt such a T-post for a variety of uses.

A further object of this invention is to provide an improved wedge member for releasably securing a mounting collar to a fence post.

In a preferred embodiment of the invention, a mounting collar for attachment to a fence post includes a hollow collar member having a cross-sectional dimension to permit it to slideably fit over a fence post leaving a space between the collar member interior and the fence post. The collar member has a top edge and a bottom edge, and a double action expansion cam wedge member is placed in the space between the collar member interior and the fence post to wedge the top edge of the collar member and the post and the bottom edge of the collar member and the post to secure the collar member onto the fence post in alignment with the post.

DETAILED DESCRIPTION

Figure 1:
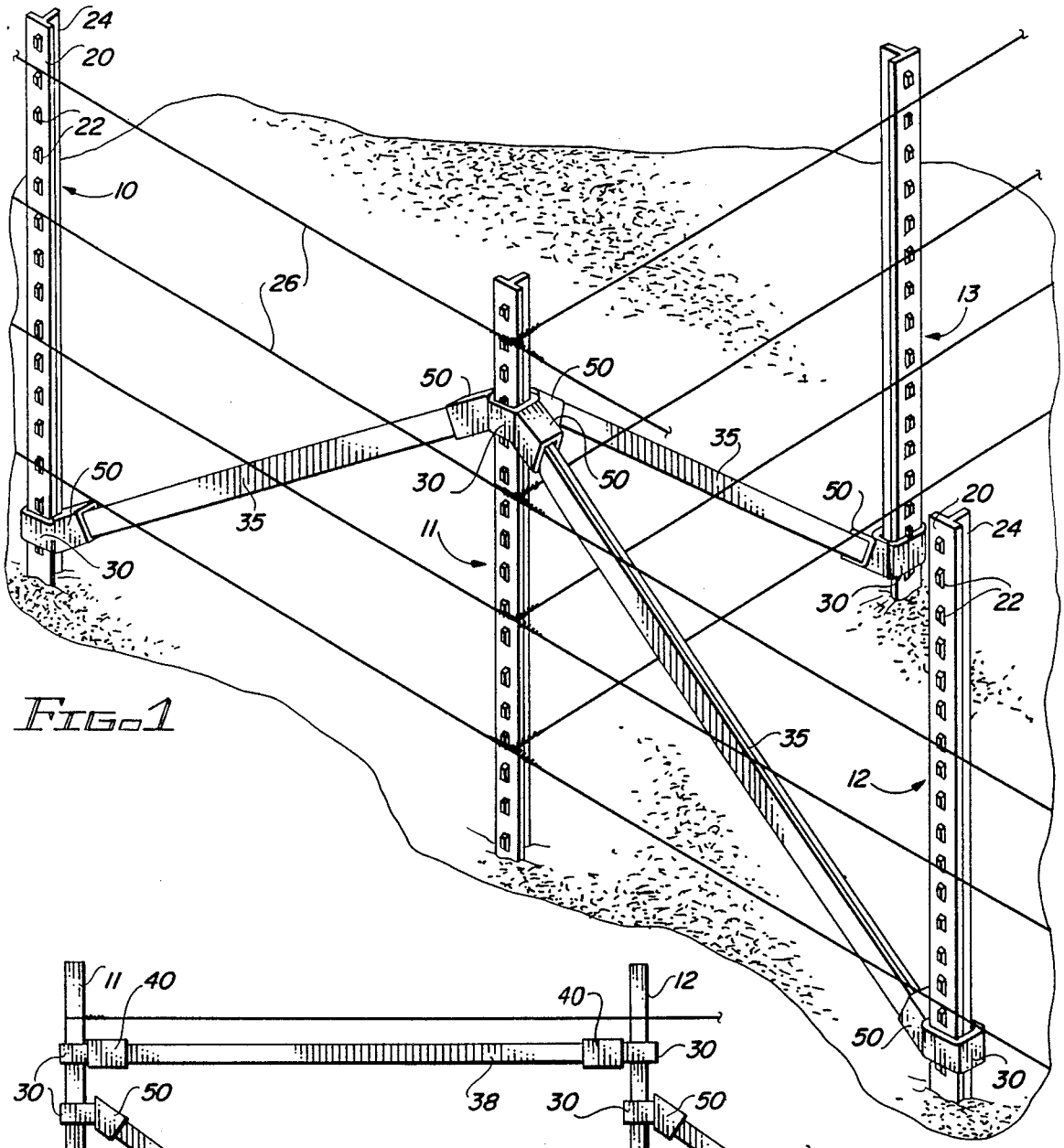
FIG. 1 is a perspective view of a portion of a fence illustrating a preferred embodiment of the invention.

Reference now should be made to the drawings in which the same reference numbers are used throughout the different figures to designate the same components. FIG. 1 illustrates a portion of a typical fence construction, showing a three-way corner. Four "T-post" fence posts 10, 11, 12 and 13 are shown in the portion of the fence illustrated. Each of these posts includes a front face 20 having a vertical row of spaced lugs 22 on it. This face is attached to a rear leg 24, and the junction of the rear surface of the front face 20 and the rear leg 24 forms the "T" configuration for which such posts are named. The posts 10, 11 and 12 are illustrated in a typical spaced-apart relationship used for a fence line. The post 13 is aligned with the post 11 for a fence line which is perpendicular to the one consisting of the posts 10, 11 and 12. Thus, the post 11 is a corner post. Wires 26, usually barbed wire, are strung between the posts to form the fence. Since the portion which is illustrated in FIG. 1 is at a corner, the posts 10, 12 and 13 are located closer to the post 11 than the normal post to post spacing used along the length of the fence. These posts, however, could be located at the usual spacing, if desired.

To brace the installation of FIG. 1 in accordance with the teachings of this invention, collars 30, having an internal rectangular opening in them are slipped over the tops of each of the posts 10, 11, 12 and 13. These collars have an internal opening of sufficient size to permit them to be moved to any desired vertical location along the posts 10 through 13. As illustrated, the collars on the posts 10, 12 and 13, are placed near the bottoms of these posts, while the collar 30 on the post 11 is shown located near the top of that post.

Once the desired location for a collar 30 is determined, the collar 30 is secured to the post in a manner described subsequently so that it does not move vertically on the post. Each of the collars 30, also has a provision for releasably attaching a brace socket 50, as illustrated in FIG. 1. The brace sockets 50 each have an opening in them to receive one end of a rigid cross-brace 35. The sockets 50 may be placed over the ends of the cross-brace 35 prior to securing the holders 50 on the collars 30, or the holders may be secured to the collars before inserting the cross-brace 35. In accordance with the preferred embodiment, all of the parts simply slip together without requiring any additional fasteners.

Once all of the collars 30, brace holders 50, and braces 35 are in position, the post with the collar 30 located near its upper end (post 11 in FIG. 1) may be driven downwardly into the ground an additional short distance to rigidly secure all of the components together. Consequently, the cross-bracing is obtained without requiring any drilling of holes, welding, cutting of parts or driving of threaded fasteners and the like. The bracing structure which is provided is effective and rigid and prevents the corner from being pulled in any of the three directions by the tension of the wire which is strung between the various posts.

Figure 2:
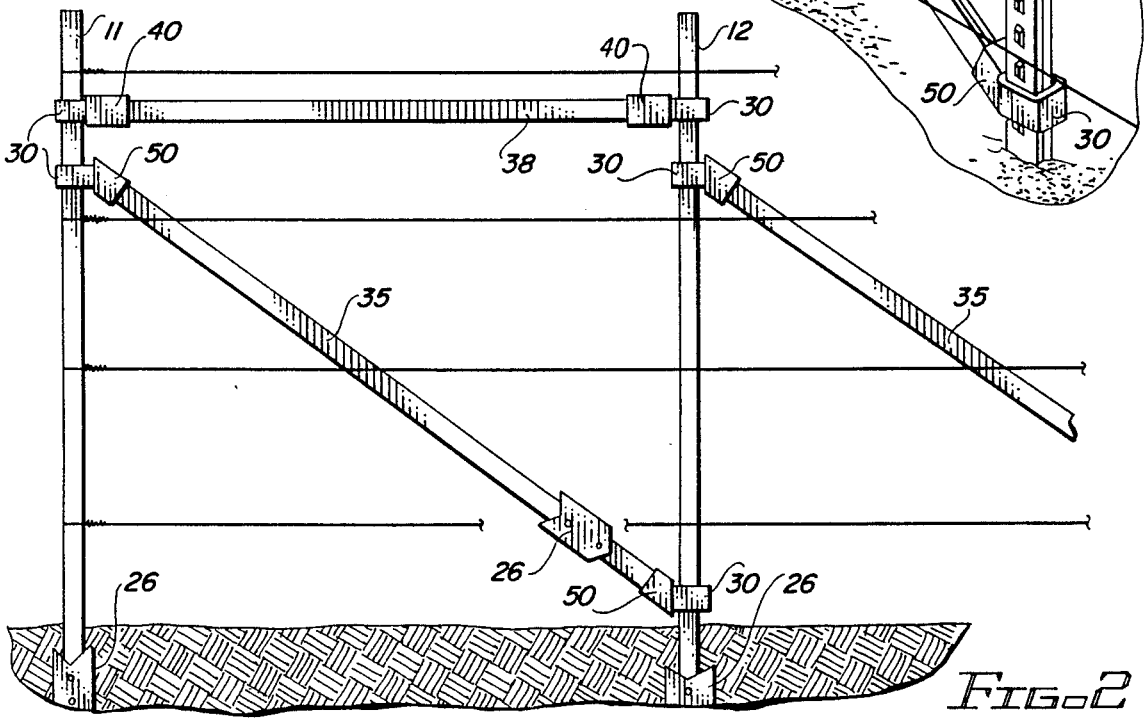
FIG. 2 is a side view of a fence construction illustrating features of a preferred embodiment of the invention.

FIG. 2 is a side view of the arrangement of the braces and posts used for a typical line post bracing arrangement, which differs slightly from the line post bracing provided between the posts 10, 11 and 12 of FIG. 1. In FIG. 2 the posts 11 and 12 and the collars 30, brace sockets 50 and rigid brace 35 are illustrated in the same position they occupy in FIG. 1. In addition, however, a second collar 30 is provided on the post 11 located above the lower collar 30; and second and third collars 30 are provided near the top end of the post 12. The uppermost collars 30 have a pair of brace sockets 40 attached to them with a horizontal brace extending between the brace sockets 40, so that additional bracing is provided between the posts 11 and 12 to form a triangular brace consisting of the cross-brace members 35 and 38 along with the attachments to the posts 11 and 12. The intermediate collar 30 is used for securing a brace socket 50 for the end of a brace 35 extending to the right to the next post (not shown) in the fence.

FIG. 2 also illustrates the conventional T-post lower guide 26 which is driven into the ground on the posts 11 and 12. In addition, FIG. 2 illustrates the manner in which a standard length T-post 35 is inserted into the brace sockets 50 attached to the lower ones of the collars 30 on both of the posts 11 and 12.

To install the brace configuration shown in FIG. 2. The post 11 first is driven into the earth in the desired position. The post 12 then also is driven in alignment with the post 11 such that the distance between the posts 11 and 12 is approximately one (1) foot less than the length of the T-post 35 which is to be used for the cross-brace. The collar 30 then is mounted on the post 11 near its upper end, as shown. The socket 50 next is secured to the collar 30. Another collar 30 (with a socket 50) is mounted on the post 12, and this collar is located near the place where the post 12 enters the ground.

The middle collar 30 on the post 12 is then secured in place as shown and finally, the upper collars 30 on both of the posts 11 and 12 are secured in place. These two upper collars are located on a line which is substantially horizontal, as illustrated in FIG. 2. An upper brace 38, which may be cut to length from a standard T-post, is inserted into the pair of sockets 40 which then are attached to the upper collars 30. Similarly, the T-post brace 35 (FIG. 2) is inserted into the pair of sockets 50 which are attached to the collars 30, in a manner subsequently to be described.

The sockets 40 and 50 may be attached first to the corresponding cross-braces or they may be attached to the respective collars 30 first, with the brace-post members 35 and 38 then inserted subsequent to the collar placement. If this latter approach is taken, the post 12 is flexed away from the post 11 to permit placement of the ends of the brace-post member 35 into the sockets 50 and the ends of the brace-post 38 into the sockets 40. The post 12 then is returned to its vertical position and the fence is strung with wire placed under tension. The brace-post members 35 and 38 are held in place at both ends by the sockets 50 and 40. The rigid structural triangles which are formed by the posts 11, 35 and 12 and by the posts 12, 35 and 38, provide the necessary rigidity to prevent displacement of the post 11.

If the earth in which the fence posts are placed is relatively hard, the cross-post brace 38 and its associated hardware may be ommitted. For soft earth, however, this additional cross-post bracing provides additional necessary resistance to displacement of the post 11 resulting from the tension of the wire during the fence installation and subsequently. It should be noted that after the cross-brace member 35 (or members 35 and 38) are put in place, the post 11 may be driven downwardly into the ground a short distance to tighten all of the brace connections. This procedure may be used at any point in the fence construction to tighten any lose brace connections which remain after installation of the various portions of the post-brace system. Absolute tightness, however, is not essential since all of the various connections tighten during the wire stretching which occurs during the installation of the fence.

Figure 3:
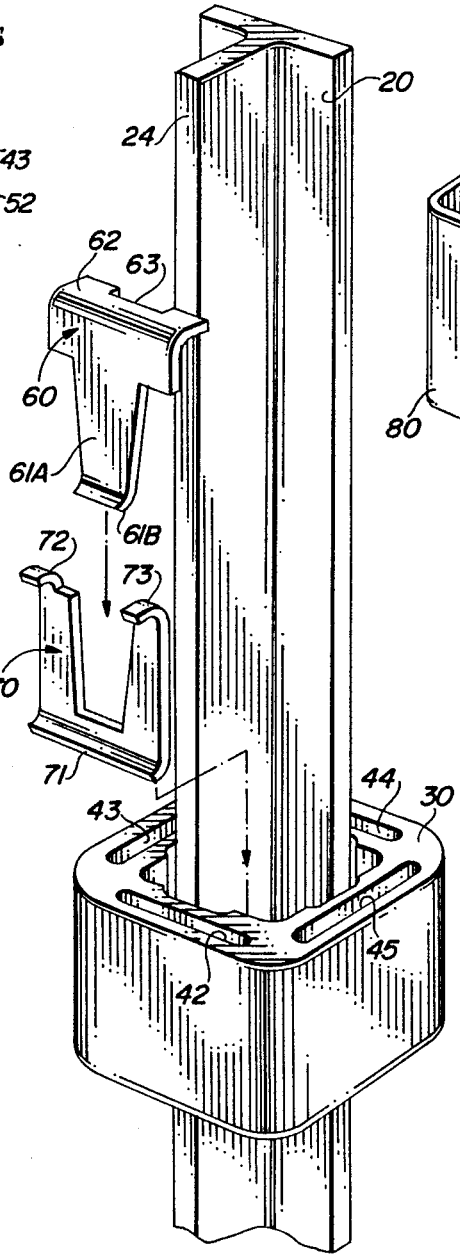
FIG. 3 is an enlarged, partially exploded perspective view showing the installation of a preferred embodiment of the invention on a T-post.

Reference now should be made to FIGS. 3 and 4, which illustrate the details of the collars 30, described generally in conjunction with FIGS. 1 and 2. FIG. 3 shows a preferred embodiment of the collar 30 of the invention which permits the mounting of various hardware components onto a T-post, such as the posts 11 through 13 of FIGS. 1 and 2. The collar 30 has a rectangular (preferably square) longitudinal internal opening through it. In addition, each side of the collar 30 includes an elongated rectangular slot 42, 43, 44, or 45 through it parallel to the longitudinal axis of the collar and parallel to the inner surfaces of the internal opening. In addition, each of the four sides of the collar 30 has a longitudinal groove or depression 52 located in it and extending throughout the length of the collar from the top edge to the bottom edge. These grooves are shown most clearly in the top views of FIGS. 4A through 4D. The slots 42 through 45 pass entirely through the longitudinal dimension of the collar 30 from end to end and are used for the slip-fit attachment of various hardware items, as described more fully in the above-mentioned co-pending application Ser. No. 07/256,451.

To attach the collar assembly between adjacent spaced lugs 22 on the T-post 24, a camming wedge assembly is used. The wedge illustrated in exploded form in FIG. 3 is a double action expansion wedge comprising two generally rectangular members 60 and 70. The member 70 is made of a metal plate of uniform thickness and is illustrated with a cut-out center portion, although the cut-out is not necessary to the construction. The lower edge 71 of the plate 70 is turned outwardly substantially 45° a short distance, as shown most clearly in FIGS. 3 and 5. The top of the cam member 70 has a pair of spaced-apart fingers 72 and 73 adapted to overlie the upper edge of the collar 30, as shown most clearly in FIGS. 4D and 5.

Figure 4A:
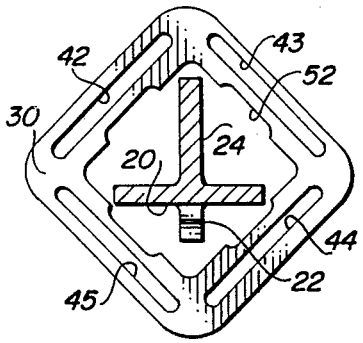
FIGS. 4A through 4D are top views illustrating the manner of installation of the device of FIG. 3 on a conventional T-post.
Figure 4B:
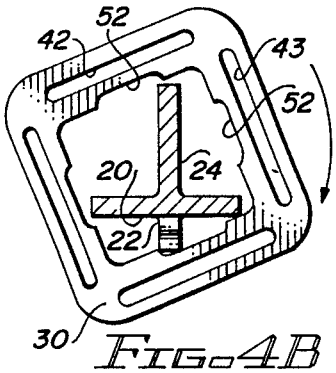
Figure 4C:
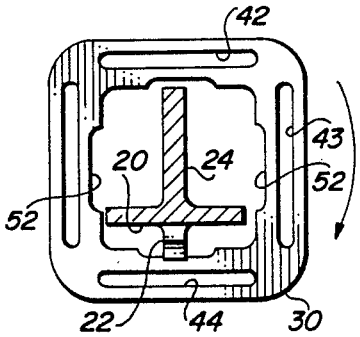
Figure 4D:
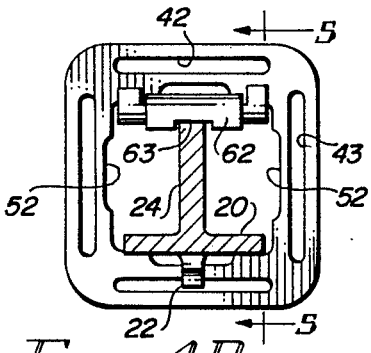
Figure 5:
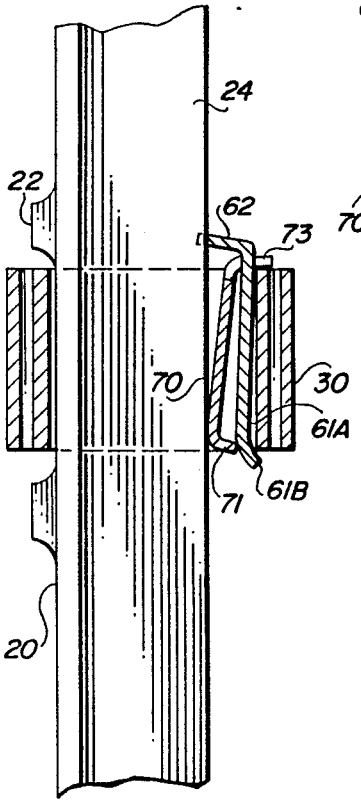
FIG. 5 is a cross-sectional view taken along the line 5—5 of FIG. 4D.

The second wedge member 60 has an upper edge 62 turned inwardly, in the opposite direction from the orientation of the edge 71 of the member 70, to face the rear leg 24 of the T-post when the wedge assembly is inserted in the manner indicated in FIGS. 3, 4D and 5. A bottom projection or leg 61A of the member 60 extends between the inner surface of the collar member 30 in the facing groove 52 and the front edge of the bottom 71 of the member 70, in the manner most clearly illustrated in FIG. 5. An actual outwardly turned edge 61B on the bottom of the leg 61A locks the member 60 onto the collar 30, also as shown most clearly in FIG. 5.

The members 60 and 70 also can be made as a single stamped metal piece held together by break-away tabs. When the expansion wedge made in this manner is used, the portion 62 is struck with a hammer to break the tabs and position the member as shown in FIG. 5.

FIGS. 4A through 4D illustrate the manner in which the collar 30 is placed on a T-post and subsequently securely held in place by the double action expansion wedge members 60 and 70, shown in FIG. 3. In FIG. 4A, the collar 30 is shown in position to be moved downwardly over the top of a T-post after the T-post has been driven into the ground. The distance between opposite internal walls of the opening of the collar 30 is selected to be slightly greater than the overall front to back distance of the T-post between the rear surface of the leg 24 to the outermost projection of the lugs 22. The face 20 of a conventional T-post typically is not as wide as this front-to-back dimension. Consequently, the collar 30 readily may be slipped into place and moved to any desired vertical location on the T-post, as shown in FIG. 4A. Generally, this location of the collar is achieved by orienting the collar on a diagonal with respect to the leg 24 and projections 22, since this provides the greatest clearance to facilitate placement of the collar on the T-post.

When the desired location is found, the collar 30 is rotated approximately 45° (either counterclockwise or clockwise, as shown in FIGS. 4B and 4C) to provide the orientation illustrated. Then the collar 30 is pushed toward the front surface of the front face 20 to cause the inside wall of the opening in the collar 30 which faces that surface to engage the front face 20 between a pair of adjacent lugs 22. This is shown most clearly in FIG. 4D and FIG. 5.

To hold the collar 30 in place on the post, the wedge member 70 first is placed in position in the space between the rear edge of the leg 24 and the internal surface of the collar 30 with the fingers 72 and 73 resting on the top edge of the collar 30. Next, the wedge member 60 is placed in position with the lower portion or lower leg 61A of the member 60 extending in front of the outwardly turned lower edge 71 of the member 70, as illustrated most clearly in the cross-sectional view of FIG. 5. The member 60 then is driven downwardly by applying force, such as with a hammer, on the upper surface 62, to wedge it into place as shown in cross-sectional view in FIG. 5 and as shown in the top view of FIG. 4. Alternatively, the alternative single piece wedge assembly is used, as described above.

When this is done, the upper edge of the wedge member 60, at the point where the bend is made to form the top 62, presses against the interior surface of the collar 30 on opposite sides of the groove 52. The slot 63 firmly engages the rear edge of the leg 24. It also is apparent that the width of the portion 62 is selected to fit in the space between the fingers 72 and 73 of the member 70. When the leg 61A of the member 60 presses between the edge of the portion 71 of the member 70 and the bottom portion of the groove 52 near the bottom edge of the member 30, the bight or bend between the plane of the main body portion 70 and the outwardly turned edge 71 is pressed tightly against the rear edge of the leg 24, while the projection 61 wedges tightly between the member 71 and the collar 30 near its lower edge. The projection 61B on the leg 61A is selected to be such that it extends slightly below and under the lower edge of the collar 30 when all of the parts are tightly wedged into place, as illustrated in FIG. 5. This locks the assembly in place. Also, this structure facilitates dismantling of the collar 30 from the post, if that should be desired.

The assembly which is illustrated functions as a double action expansion cam wedge which causes the collar 30 to be tightly held against the post through two different spaced-apart wedging actions to maintain accurate longitudinal alignment of the collar 30 with the longitudinal axis of the T-post. This results from the pressure applied near the top edge of the collar 30 by the wedge member 60 and, similarly, pressure applied near the bottom edge of the collar 30 through the combination of the leg 61 interacting with the edge 71 on the member 70. This double action wedging operation significantly reduces misalignment of the collar member and facilitates the interconnection of the slip-fit bracing system disclosed in detail in co-pending application 07/256,451.

Figure 6:
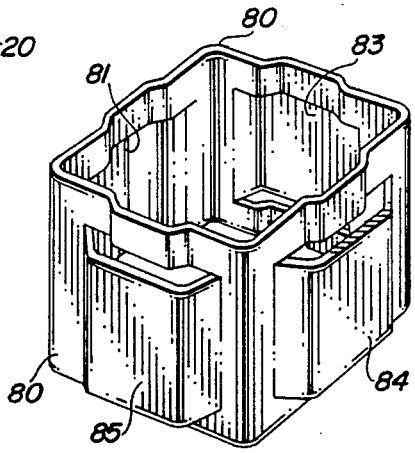
FIG. 6 is an enlarged perspective view of an alternative to a portion of the embodiment shown in FIG. 3.
Figure 7:
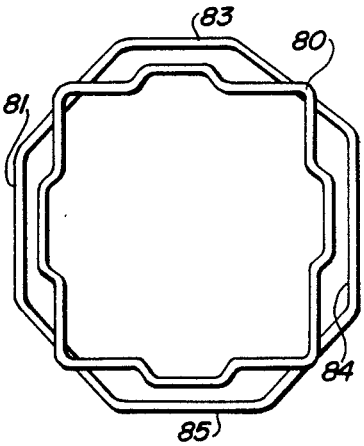
FIG. 7 is a cross-sectional view of the device shown in FIG. 6.

FIGS. 6 and 7 illustrate an alternative embodiment of a collar member 80 which may be substituted for the collar 30 illustrated in FIGS. 3 through 5. The collar 80 has an internal longitudinal rectangular opening (preferably square) which is of substantially the same dimensions or configuration as the internal opening in the collar 30, described above. The collar of FIGS. 6 and 7, however, is made from a single thickness of sheet metal, such as steel or aluminum, and has formed open-ended, tongue-receiving projection pockets 81, 83, 84 and 85, extending longitudinally and outwardly from the central portion of each of the four surfaces, as shown in FIGS. 6 and 7. These pockets are comparable to the slots 42, 43, 44 and 45 of the embodiment shown in FIGS. 3 through 5.

Figure 8A:
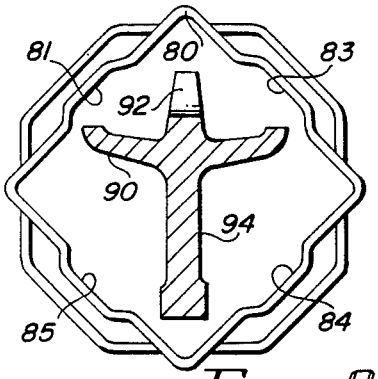
FIGS. 8A through 8D are top views illustrating the manner of installation of the device of FIG. 6 on a conventional T-post.
Figure 8B:
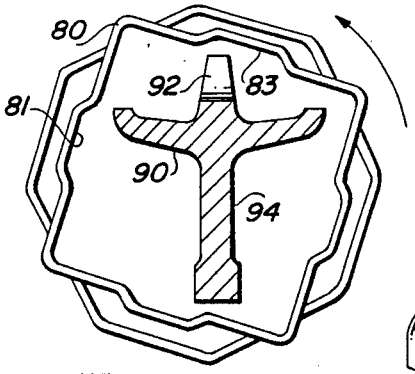
Figure 8C:
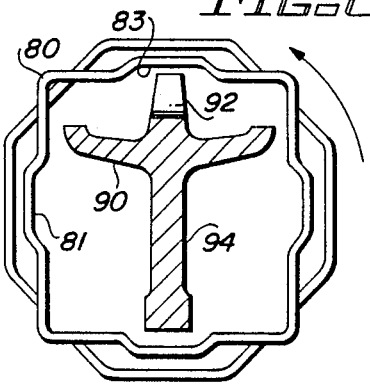
Figure 8D:
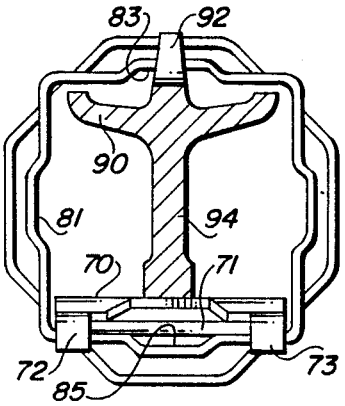
Figure 8E:
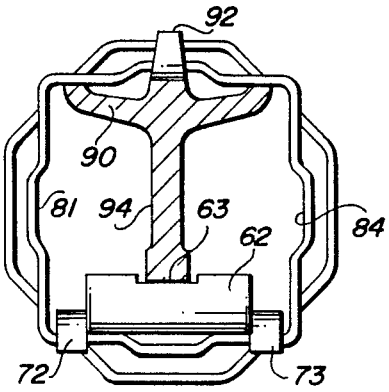
Figure 9:
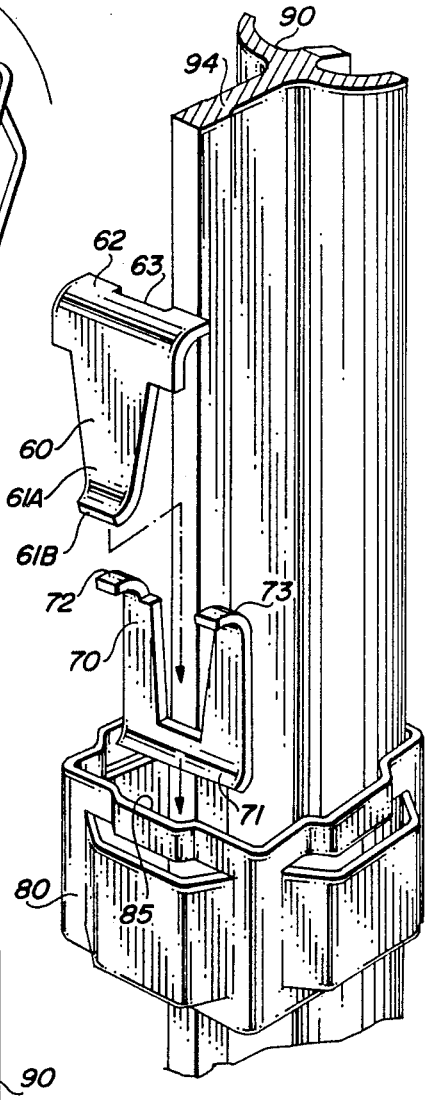
FIG. 9 is an enlarged, partially exploded perspective view showing the installation of the embodiment of FIGS. 6 through 8 on a conventional T-post.
Figure 10:
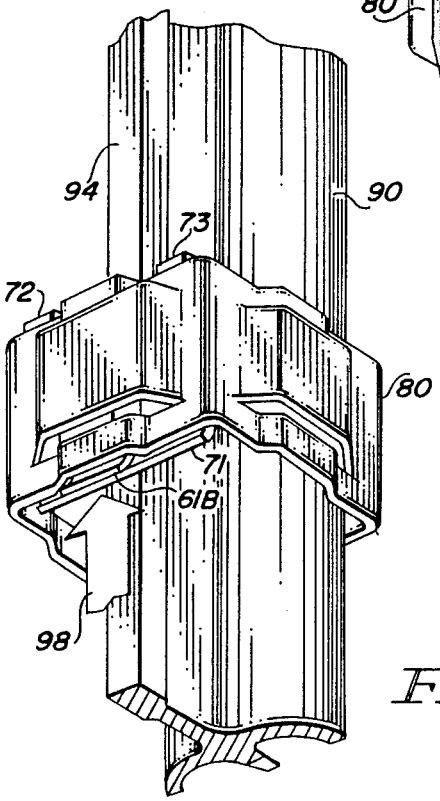
FIG. 10 is a bottom perspective view illustrating the manner in which the device of FIG. 9 may be removed from a T-post.

FIGS. 8A through 8E and FIGS. 9 and 10 illustrate the manner of placing and securing the collar 80 on a metal T-post having a slightly different configuration from the T-post shown in FIGS. 3 and 5. In FIGS. 8 through 10, the T-post has a rear leg 94 with a slightly curved front face 90 from which spaced lugs 92 project. The manner of installation of the collar 80 or the collar 30 on the T-post 90/94 of FIGS. 8 through 10, is effected in the same manner described above in detail in conjunction with the embodiment shown in FIGS. 4A through 4D. FIGS. 8A through 8E illustrate the various installation steps. The placement and orientation are shown in 8A through 8C. Once the collar 80 is in place between the desired adjacent projections 92, it is moved into the position shown in FIG. 8D; and the wedge member 70 is placed in the space between the rear edge of the rear leg 94 and the internal surface of the collar member. Then the wedge 60 is driven into place, as shown in FIG. 8E, to secure the entire assembly together.

FIG. 9 is an exploded view similar to FIG. 3, and illustrates the manner of insertion and orientation of the various parts to achieve the double action cam wedging operation to secure the collar 80 on place on the T-post 90/94.

FIG. 10 is a bottom view of an installed collar 80, illustrating the manner in which the lower edge 61B of the leg 61A extends beyond and under the bottom edge of the collar 80. If a hammer is used to drive the lower edge 61B of the leg upwardly, as indicated by the arrow 98, the wedge member 60 may be popped out of wedging engagement to disassemble the double action cam wedge.

The various accessories which are capable of use with the collar 30 also may be used in conjunction with the collar 80, since the pockets or slots 81, 83, 84 and 85, formed on the four internal surfaces of the collar 80 permit the slip-fit attachment of accessories with the collar 80 in the same manner as is accomplished by means of the slots 42 through 45 in the collar 30.

Typically, all of the various parts of the collar assembly, including the double action cam members 60 and 70 are made from aluminum or other suitable material.

The above descriptions of the preferred embodiments of the invention and of the various manners of use and installation are to be considered as illustrative and not as limiting. Various changes and modifications will occur to those skilled in the art without departing from the true scope of the invention as set forth in the appended claims.

I claim:

1. A mounting mechanism for attaching a collar to a fence T-post where the collar is a hollow collar member having a predetermined length with a top edge and a bottom edge and with a substantially rectangular internal cross-section dimensioned in at least the diagonal thereof to permit said collar member to slideably fit over a fence T-post with a space between the interior of said collar member and such fence T-post, said mechanism comprising:

a double action expansion wedge member for wedging engagement between said post and the top edge of said collar member and between said post and the bottom edge of said collar member to hold said collar member wedged onto said fence post and aligned therewith.

2. The mechanism according to claim 1 wherein said double action expansion wedge member has an upper transverse edge and a lower transverse edge providing said wedging engagement between said post and the top edge of said collar member and the bottom edge of said collar member, respectively.

3. The mechanism according to claim 2 wherein said double action expansion wedge member comprises first and second facing tapered wedge members slideably engaging one another in said space between said collar member interior and said fence post.

4. The mechanism according to claim 3 wherein said first and second wedge members are of substantially rectangular configuration.

5. The mechanism according to claim 3 wherein said upper edge of said second wedge member has a slot formed substantially in the center thereof for engaging said fence post.

6. The mechanism according to claim 1 wherein said expansion cam member comprises a first wedge member having an upper narrow portion and a lower wide portion, with first and second spaced fingers on the upper portion for extension over the top edge of said collar member, and a second wedge member having a narrow lower portion and a wide upper portion for insertion between the fingers of said first wedge member and adapted to be driven downwardly between such fingers to cause the wide upper portion thereof to wedge between said fence post and said collar member near the top edge thereof, with the lower portion of said second wedge member engaging the lower portion of said first wedge member and forcing said first wedge member into tight engagement with said fence post near the bottom edge of said collar member.

7. The mechanism according to claim 6 wherein said first and second wedge members are made of uniformly thick material having planar main body portions, with said wide portions provided by bending said material at an angle with respect to the planes of the main body portions thereof.

8. The mechanism according to claim 7 wherein said first wedge member is made of a substantially flat rectangular plate of metal of uniform thickness, with said first and second fingers extending from the top thereof and extending substantially 90° from said rectangular plate of metal, and said wide lower portion of said first wedge member is formed by bending the lower edge of said plate of metal a predetermined distance in the same direction as said first and second fingers extend.

9. The mechanism according to claim 8 wherein said second wedge member also is formed from a substantially flat rectangular metal plate of uniform thickness, with said wide upper portion formed by bending the upper edge of such plate a predetermined distance at a predetermined angle from the plane of such plate.

10. The mechanism according to claim 9 wherein said bent upper edge of said second wedge member has a slot formed substantially in the center thereof for engaging said fence post, and the lower edge of second wedge member is bent slightly outwardly to underlie the lower edge of said collar when said second wedge member is fully driven downwardly.

11. The mechanism according to claim 1 wherein said double action expansion wedge member has an upper transverse edge and a lower transverse edge providing said wedging engagement between said post and the top edge of said collar member and the bottom edge of said collar member, respectively.

12. The mechanism according to claim 1 wherein said collar member further has accessory holding means thereon.

13. A mounting mechanism for attaching a collar to a fence post where the collar is a hollow collar member having a predetermined length with a top edge and a bottom edge and with a cross-sectional dimension selected to permit said collar member to slideably fit over a fence post with a space between the interior of said collar member and such fence post, said mechanism comprising:

a double action expansion wedge member comprising first and second facing tapered wedge members slideably engaging one another in said space between said collar member interior and said fence post for wedging engagement between said post and the top edge of said collar member and between said post and the bottom edge of said collar member to hold said collar member wedged onto said fence post and aligned therewith.

14. The mechanism according to claim 13 wherein said first and second wedge members are made of uniformly thick material having planar main body portions, with said wide portions provided by bending said material at an angle with respect to the planes of the main body portions thereof.

* * * * *